United States Patent [19]

Bishop

[11] 4,397,416

[45] Aug. 9, 1983

[54] HANDLE ACCESS FLAP

[76] Inventor: Richard E. Bishop, 3 Abner Pl., Weston, Ontario, Canada, M9R 3L9

[21] Appl. No.: 324,160

[22] Filed: Nov. 23, 1981

[51] Int. Cl.[3] ..... B65D 5/46; B65D 25/28

[52] U.S. Cl. ..... 229/52 BC; 206/141

[58] Field of Search ..... 229/52 B, 52 BC; 206/141

[56] References Cited

U.S. PATENT DOCUMENTS

| | | | |
|---|---|---|---|
| 2,684,759 | 7/1954 | Freeman | 229/52 BC |
| 3,554,402 | 1/1971 | Lock | 229/52 B |
| 3,692,232 | 9/1972 | Helms | 229/52 B |
| 3,747,801 | 7/1973 | Graser | 229/52 BC |
| 3,807,625 | 4/1974 | Akkerman | 229/52 BC |
| 3,820,710 | 6/1974 | Burgess | 229/52 B |
| 4,345,711 | 8/1982 | Fisher | 229/52 B |

FOREIGN PATENT DOCUMENTS

| | | | |
|---|---|---|---|
| 458683 | 8/1949 | Canada | 229/52 B |
| 909180 | 9/1972 | Canada | 229/52 B |
| 1232539 | 4/1960 | France | 229/52 BC |
| 766964 | 1/1957 | United Kingdom | 229/52 B |

*Primary Examiner*—Herbert F. Ross

[57] ABSTRACT

Access to the handle or hand hole in the central partition of a beer box or the like is provided by means of an access flap formed from a top panel and positioned adjacent to but on one side of the partition panel, a first fold line connects a main panel to three spaced part connecting panels each of which is foldably connected to a top panel of the box by aligned connecting fold lines parallel to the first fold line. Tabs extend from the top panel between each pair of adjacent connecting panels to the first fold line. These tabs are positioned immediately over a pair of adjacent bottles and extend beyond the top of the bottles toward the partition by an amount sufficient to permit the main panel and connecting panels to move into the box by folding about the connecting fold lines. The movement of the main panel is limited by engagement of the main panel with the bottles or the caps on the bottles so that the main panel remains in position to protect the hand from engaging the tops of the bottles.

3 Claims, 4 Drawing Figures

HANDLE ACCESS FLAP

FIELD OF THE INVENTION

Present invention relates to the prartitioned box having a hand hole in the partition and is particularly concerned with the access flap protecting the hand when it extends into the box for carrying by extending the fingers through the handhole in the partition.

BACKGROUND TO THE INVENTION

Concern for customers carrying boxes particularly those used for the marketing of beer to prevent injury to the hands of the customer is a major consideration of the beer company. Boxes wherein the hand hole is provided in the partition and wherein it is necessary to reach into the box through a hole in the top wall and to carry the box with the fingers extending through the hand hole in the partition poses problems that are primarily due to the lack of space between the bottle necks and caps and the central partition.

Attempts have been made to solve this problem for example as disclosed in Canadian Pat. No. 950866 issued July 9, 1974 to Akkerman a hand hole access panel is folded on a hinge line positioned between a pair of adjacent bottles into the box and then the panel itself folded along two fold lines substantially perpendicular to the first fold line by engagement with the body of the containers (beer bottles) within the box to form a substantially U-shaped protective figuration. The U-shaped arrangement limits in width the opening and created difficulties for customers with rather large hands.

Another arrangement to protect the hands is described in Canadian Pat. No. 967524 issued May 13, 1975 to Stone. Protection is provided by dividing the access panel into three discreet flaps which independently move into the container when the hand is inserted to grasp the handhold in the partition and an insert is provided extending from the partition towards the bottles to further protect the hand.

BRIEF DESCRIPTION OF PRESENT INVENTION

Present invention provides new hand hole access panel to accommodate a wide hand and to provide adaquate partition for hands carrying the box bia the hand hole in the partition.

Broadly the present invention relates to a handle access flap adapted to form an access opening to a hand hole in a partitioning box comprising a main panel adjacent to but positioned on one side of said hand hole, a first fold line connecting the main panel to three spaced apart connecting panels each of which is foldably connected to a top wall of the box by a connecting fold line, said connecting fold lines being in axial alignment and substantially parallel to said first fold line to a side wall of the box, two tabs projecting from the top wall toward said hand hole, one between each pair of adjacent said connecting panels each of said tabs positioned immediately over one of a pair of adjacent bottle tops when said box is filled with bottles and projecting beyond said tops toward said hand hole by a distance sufficient to permit said main panel to move into said box by folding of said connecting fold lines by an amount limited by contact of main panel with the bottles and into a position wherein said main panel protects a hand from engagement with tops of said bottles.

Further features, objects and advantages will be evident from the following detailed description of the preferred embodiment of the present invention taken in conjunction with the accompanying drawings in which.

DESCRIPTION OF THE PREFERRED EMBODIMENTS

Figure 1:
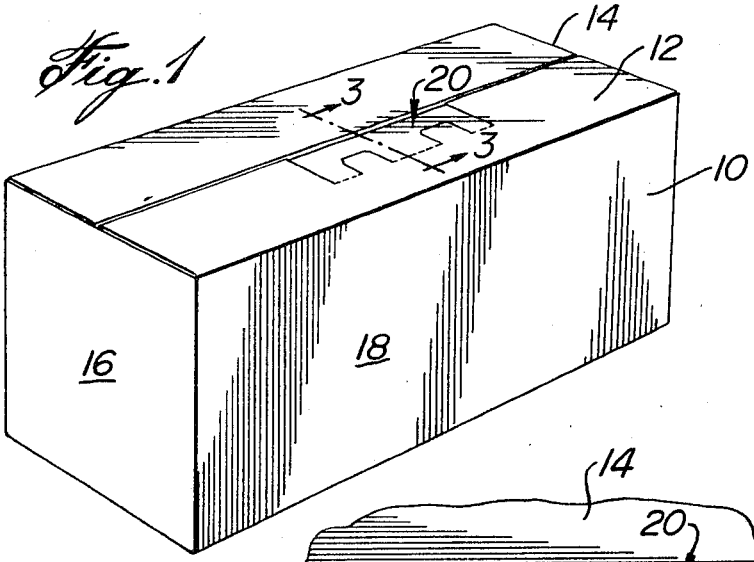
FIG. 1 is an isometric view of one type of box incorporating the access flap of the present invention.

As shown in FIG. 1 the access panel may be provided on any conventional carton such as a box made of corrugated board and having a central partition 50 with a hand hole 52 therein and adapted to carry bottles such as beer bottles in say 6 by 6 arrangement. The drawings illustrate a top load box having a pair of top closure flaps 12 and 14, end wall panel 16, sidewall panel 18, as well as the bottom and opposite side walls not illustrated. While the handle access flap generally indicated at 20 has been shown applied to the top closure flap 12 a similar flap also may be provided as a mirror image on the flap 14 if desired. Similarly the hand hole access flaps may be incorporated in a top panel to provide access to a hand hole in a divider in an end load type box.

Figure 2:
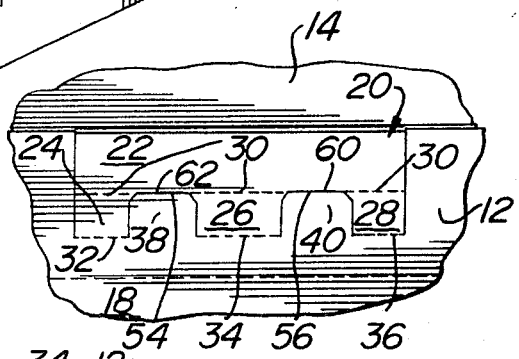
FIG. 2 is an enlarged plan view of the access flap and top panel.

As shown in FIG. 2 the access flap 20 is composed of a main panel 22 foldably connected to three connecting panels 24, 26, and 28 by a fold line 30 which is substantially parallel to the side wall 18 of the carton. Each of these connecting panels 24, 26, and 28 is connected to a top flap 12 by means of axially aligned fold lines 32, 34, and 36 respectively which are parallel to the fold line 30. Between the connecting panels 24 and 26 is a tab 38 and a similar tab 40 is provided between the connecting panels 26 and 28. These tabs 38 and 40 projects toward the partition 50 and terminate in a free edge 54 and 56 respectively which define contacting edges 60 and 62 on the panel 22 (as will be described herein below). The tabs 38 and 40 are positioned in the top flap 12 to directly overlie the bottle tops 42 and 44 of the bottle 46 and 48 (see FIGS. 3 and 4) and remain in the plane of the top wall formed by the flaps 12 and 14 when the access flap 20 is folded into the box to permit access to the hand hole.

Figure 3:
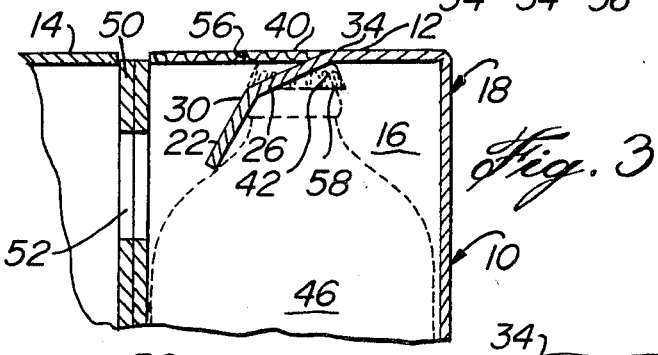
FIG. 3 is a section along the line 3—3 of FIG. 1.
Figure 4:
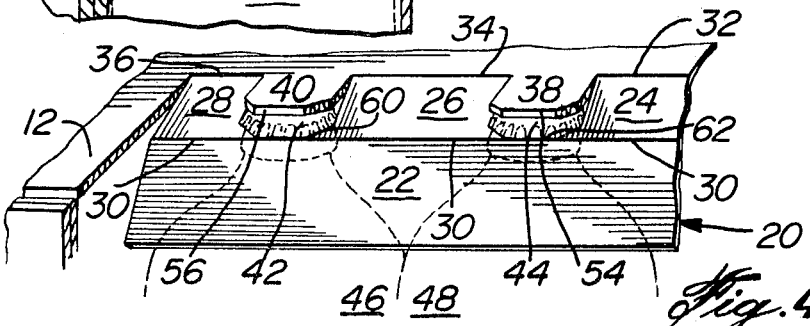
FIG. 4 is a view looking from above and adjacent to partition panel toward one side wall illustrating the access flap folded in to permit access to the handle.

As shown in FIG. 3 the access flap 20 is folded along the fold line 32, 34, and 36 and along the fold line 30 into the position as shown in FIG. 3 to provide access to the opening 52 in the partition 50 which forms the hand hole 52.

In operation the panel 22 is folded into the box against the shoulder of the bottles 46 and 48 and the connecting panels 24, 26, and 28 are folded down between the caps 42 and 44 and the caps of the next adjacent bottles while the tabs 38 and 40 remain resting on these caps 42 and 44 with their free end edges 54 and 56 being slightly closer to the central partition than the innermost edge of the caps 42 and 44. The amount these edges 54 and 56 project beyond the caps 42 and 44 must be sufficient to permit the panel 22 to fold into the box substantially as shown in FIG. 3 by providing clearance of the caps for the contacting sections or edges 60 and 62 to permit the main panel 22 to move into the box a predetermined distance before the edges 60 and 62 contact the bottles 46 and 48 and limit movement of the panel 22.

In the illustrated arrangement the fold line 30 has been shown as aligned with the edges 60 and 62; however, this is not absolutely essential. It is simply essential that the edges 60 and 62 be spaced a sufficient distance inward relative to the tops of the bottles so that the panel 22 overlies the edge 58 of the bottle caps 42 (or 44) as shown in FIG. 3 and functions to protect the knuckles when the hand is inserted through the opening provided by movement of the access panel 20 into the box. The edges 60 and 62 need not engage the caps and in some cases may engage the necks of the bottles immediately below the caps yet close enough to the edges 58 to provide protection. Generally if protection is to be afforded the permissable distance below the edges 58 of the edges 60 and 62 will be determined by the thickness of the board from which the top flap 12 is made i.e. if the board is thin it may not be practical for the edges 60 and 62 to engage the neck of the bottles since it will leave the edges 58 exposed. Limited movement round the hinge or fold lines 32, 34, and 36 permits the fold line 30 and edges 60 and 62 to move into the box to a depth wherein the edges 60 and 62 preferably engage the caps 42 and 44 but in some cases the edges 60 and 62 may be positioned immediately below and close enough to the edges 58 to protect the hand from scraping on the edges 58.

Having described the invention modifications, it will be evident to those skilled in the art without departing from the spirit of the invention as defined in the appended claims.

I claim:

1. A box comprising a top wall, bottom wall, side wall, a central partition, a hand hole formed in said partition adjacent said top wall, an access flap formed in said top wall to provide access to said hand hole in said partition, said access flap comprising a main panel adjacent to but positioned on one side of said hand hole, a first fold line connecting the main panel to three spaced apart connecting panels, each of which is foldably connected to said top wall by a connecting fold line, said connecting fold lines being in axial alignment and substantially parallel to said first fold line and to said partition, two tabs projecting from said top wall toward a hand hole one between each pair of adjacent said connecting panels terminating in a free end edge, contacting edges on said main panel adjacent to said free edges, said tabs positioned to immediately overlie a pair of adjacent bottle tops when said box is filled with bottles, said contacting edges being positioned between said tops and said partition, the spacing between said contacting edges and said tops being sufficient to permit said main panel to move into said box by an amount limited by contact of said bottles by said main panel and into a position wherein said main panel protects a hand extending through an access hole formed in said top wall by movement of said access flap from engagement with said tops.

2. A box as defined in claim 1 wherein said engagement sections engage caps forming parts of said bottles when said access flap is folded into said box to provide said access hole.

3. A box as defined in claim 1 wherein said contact sections engage said bottles when said access flap is folded into said box to form said access hole immediately below caps forming parts of said bottles, but in a position to protect said hand extending through the access hole from engagement with said caps on said bottles.

* * * * *